US005993606A

United States Patent [19]

Lehleiter et al.

[11] Patent Number: 5,993,606

[45] Date of Patent: Nov. 30, 1999

[54] HEADBOX OF A PAPER MACHINE WHICH REDUCES EFFECTIVE WIDTH OF LIQUID FEED

[75] Inventors: Klaus Lehleiter, Mengen; Hans Loser, Langenau; Wolfgang Ruf, Herbrechtingen-Bolheim, all of Germany

[73] Assignee: Voith Sulzer Papiermaschinen GmbH, Germany

[21] Appl. No.: 08/985,502

[22] Filed: Dec. 5, 1997

[30] Foreign Application Priority Data

Dec. 5, 1996 [DE] Germany ..... 196 50 588

[51] Int. Cl.[6] ..... D21F 1/02

[52] U.S. Cl. ..... 162/343; 162/258

[58] Field of Search ..... 162/336, 343, 162/258, 259

[56] References Cited

U.S. PATENT DOCUMENTS

| | | | |
|---|---|---|---|
| 3,573,160 | 3/1971 | Lopas | 162/343 |
| 3,962,031 | 6/1976 | Bubik et al. | 162/343 |
| 5,196,091 | 3/1993 | Hergert | 162/258 |
| 5,549,792 | 8/1996 | Begemann et al. | 162/343 |
| 5,695,611 | 12/1997 | Bubik et al. | 162/258 |
| 5,707,495 | 1/1998 | Heinzmann et al. | 162/258 |
| 5,795,441 | 8/1998 | Lehleiter et al. | 162/258 |

FOREIGN PATENT DOCUMENTS

| | | | |
|---|---|---|---|
| 0635600 | 1/1995 | European Pat. Off. . | |
| 2346119 | 3/1975 | Germany . | |
| 4416909 | 11/1995 | Germany . | |
| 358450 | 1/1973 | U.S.S.R. | 162/343 |

*Primary Examiner*—Karen M. Hastings
*Attorney, Agent, or Firm*—Ostrolenk, Faber, Gerb & Soffen, LLP

[57] ABSTRACT

A headbox for passing fiber suspension from a headbox entrance to a headbox outlet. A microturbulence insert with a plurality of flow channels inside the headbox. The channels are defined by channel forming elements having upstream ends. The headbox has an antechamber upstream of the turbulence insert. Respective individually adjustable additional feeds for feeding at least one second liquid into the antechamber upstream of the upstream ends of the channel forming elements of the turbulence insert. The feeds are preferably directed counter to the direction of the main flow of suspension into the channels of the turbulence insert. Vanes direct the main flow of suspension through the antechamber to the channels creating a respective sectioned flow to each channel. The additional liquid feeds are positioned to feed their additional liquid into the respective sectional flows after the main flow of suspension has already been diverted to a sectional flow. A method of use of such a headbox wherein each feed of additional liquid into the main flow of suspension is deflected in the direction of the nearest channel of the turbulence insert by the main flow of suspension and by the vanes which guide the main suspension flow toward the channels and which prevent the additional liquid feed from one sectional flow entering another sectional flow.

15 Claims, 7 Drawing Sheets

HEADBOX OF A PAPER MACHINE WHICH REDUCES EFFECTIVE WIDTH OF LIQUID FEED

BACKGROUND OF THE INVENTION

The invention relates to a headbox or flowbox of a machine for producing a fiber web, in particular a paper web, and particularly relates to a structure and a method of reducing the effective width of a sectional liquid feed to each section of the headbox across its width, in or near the entry region of a turbulence insert in the main stream of stock suspension in the headbox.

A headbox receives pulp stock suspension from a supply, distributes it across the width of the headbox and sprays the suspension onto a wire screen belt of a following forming section of the paper machine. The headbox is intended to set the consistency, proportions of contents components, and fiber orientation transverse profile of the pulp stock suspension, so that the basis weight transverse profile, i.e., the cross machine profile and the fiber orientation transverse profile of the paper web produced from the suspension that exits the headbox corresponds to the desired requirements over the entire width of the web. Usually, these features are to be held constant over the width of the web. These parameters may be set at the headbox, at the latest before the exit of the suspension from the headbox.

In a dilution headbox, which is the type of headbox in this invention, the consistency of the pulp suspension is adjusted locally in sections across the headbox in order to produce a desired basis weight cross profile in the paper web produced. The narrower that the influenced width of an affected section of the paper web can be made, the better or more close to the ideal will be the cross profile of the basis weight.

When there is a goal of producing a desired fiber orientation cross profile in the web produced, then the flow rate, rather than the consistency, is adjusted locally in sections across the headbox. In the headbox, the narrower that the influenced width of an affected section of the paper web can be made, the better or more close to the ideal will be the fiber orientation cross profile of the web will be. For both the basis weight cross profile and the fiber orientation cross profile of the web, the narrower is each section of the headbox across its width, the closer to ideal will be the respective cross profiles of the web.

For this purpose, a modern headbox is equipped with sectional liquid supplies, i.e. respective controlled supplies of the suspension at the different sections across the width of the entrance to the headbox. This makes it possible, for example, to supply wire water, called "white water", i.e. water recovered from the dewatering of the suspension at the forming section, and to supply that water, individual section by section into the headbox. This influences the density of the stock or suspension flow in each section. As a result, this influences the web thickness in each section of the web across the web and also the basis weight of the web in each section across the paper web and/or, by means of section by section supply of stock suspension, this generates transverse flows in the headbox which influences the fiber orientation transverse profile of the web produced. To achieve as narrow width, influenced section across the width of the paper web as practicable, in relationship to the quantity of individual sections and the widths of the individual sections across the headbox at which consistency and/or flow rate is adjusted, it is desirable to avoid or at least minimize mixing of the sectional flows of adjacent sections over the headbox.

A modern headbox known, for example, from German patent specification DE 43 20 243 C2 comprises a machine width stock supply including a transverse distributor that delivers suspension across the inlet to the headbox, one or two turbulence inserts inside the headbox with, if appropriate, an intermediate chamber located between the inserts, and an outlet nozzle after the inserts. Furthermore, a multiplicity of individually adjustable supply lines of various liquids are provided in the region of and typically upstream of the turbulence inserts. The adjustable supply lines can supply wire water, or stock suspension or other additives to the main flow of the headbox, section by section over the width or over both the width and the height of the headbox.

This configuration of a headbox is disadvantageous, particularly for embodiments in which the section by section supply enters a channel in the headbox, because the channel is not limited laterally (FIGS. 6, 9, 10, 12 of DE 43 20 243 C2) and there are no guiding elements over the width of the chamber. The effective width of each sectional liquid supply is not limited laterally and, in addition, it is also dependent on the quantity of the liquid supplied. First, second, etc., sectional flows over the width mix laterally. As a result, the effective width of each sectional flow is too broad. A similar effect is seen with the headbox in U.S. Pat. No. 5,196,091. Hence, the basis weight cross profile of the web produced is not as well controlled as possible over narrow width sections across the web.

SUMMARY OF THE INVENTION

The primary object of the invention is to reduce the effective width across the paper web produced of each localized or sectional change in consistency and/or fiber orientation at any section across the web.

Another object is to avoid or at least minimize mixing of suspension between adjacent sections across the headbox.

A further object of the invention is to improve a headbox having a sectionalized liquid supply, wherein the effective width of the liquid supply to a section is confined to a designated section across the width of the headbox, and to also provide a method of supplying sectionalized liquid supply which achieves the same effect.

Accordingly, it is proposed to improve a known headbox for producing a fiber web, especially a paper web, having a machine width suspension supply device, e.g. a transverse distributor, for the stock suspension into the headbox.

The headbox passes fiber suspension from a headbox entrance to a headbox outlet. There is at least one device inside the headbox for generating microturbulence, e.g. a microturbulence insert having a large number of channels through the insert for flow of suspension. The channels are defined by channel forming elements having upstream ends. Each channel may be shaped to extend over the entire height of the headbox and to have a rectangular cross-section. In a preferred embodiment, the turbulence insert may alternatively comprise a plurality of tubes arranged in a matrix across the width and also over the height of the insert. See U.S. Pat. No. 5,196,091, especially FIG. 2, incorporated herein by reference.

There is at least one machine width antechamber region upstream of the microturbulence insert. There are a large number of individually adjustable additional sectional feeds, each of at least one other liquid besides the main suspension flow, into the antechamber. The additional feeds are located generally at the initial region of the turbulence insert upstream of the upstream ends of the channel forming elements of the turbulence insert. The additional feeds are preferably directed counter to the direction of the main flow of suspension into the channels of the turbulence insert. Each adjustable additional feed is intended to supply liquid to a respective section and not to other sections across the width.

There is a machine width outlet nozzle from the headbox for the stock suspension.

The invention comprises flow guide elements in the antechamber located in the region of the liquid feeds to prevent or at least sharply reduce an undesired widening, i.e. extending beyond the respective section, of the liquid supply to each section across the width.

The flow guide elements comprise vanes which direct the main flow of suspension through the antechamber to respective ones of the channels associated with each vane for creating a respective sectioned flow to each channel. The additional liquid feeds are positioned to feed their additional liquid into the respective sectional flows after the main flow of suspension has already been diverted to a sectional flow.

For example, control over flow through a section across the headbox can be obtained by configuring the headbox such that the feed direction of each feed of additional liquid is directed counter to the main flow direction of suspension through the turbulence insert, and/or the flow guide elements which confine each sectioned feed of additional liquid rest on or are fastened at the downstream ends of the flow guide elements to the turbulence insert.

It may also be advantageous for the flow guide elements to have the form of guide vanes which are curved along the main suspension flow direction from generally paralleling the main flow in the distributor to generally extending in the direction through the insert in the headbox. However, for example, for reasons of simpler production, the flow guide elements may alternately have the shape of any of a circular segment, parabola, hyperbola, polygon or rectilinear course, so long as adjacent flow elements confine flow in a section across the width.

The invention concerns a method of use of such a headbox wherein each feed of additional liquid into the main flow of suspension is deflected in the direction of the nearest channel of the turbulence insert by the main flow of suspension and by the vanes which guide the main suspension flow toward the channels and which prevent the additional liquid feed from one sectional flow entering another sectional flow.

The method reduces or confines the effective width of a sectional liquid feed in the entry region of a turbulence insert in a headbox. The main flow of suspension along with the additional liquid feed for each section across the width is deflected in the direction of the nearest entry opening into a channel in the turbulence insert. This leads to a severe restriction of the effective range of each liquid feed over the width of the headbox and hence enables locally precise correction of faults in the production process.

Advantageously, the flow of the sectional liquid feed, specifically the additional liquid feed component, can also be directed counter to the direction of the main flow in the turbulence insert, and/or the liquid feed can be deflected directly after its entry into the antechamber of the turbulence insert.

Other features and advantages of the present invention will become apparent from the following description of the invention which refers to the accompanying drawings.

DESCRIPTION OF PREFERRED EMBODIMENTS

A headbox has an entrance or inlet side, an opposite outlet with a nozzle, lateral side walls and a top and a bottom plate which enclose the headbox and possibly includes a microturbulence generating insert inside the headbox.

Figure 1:
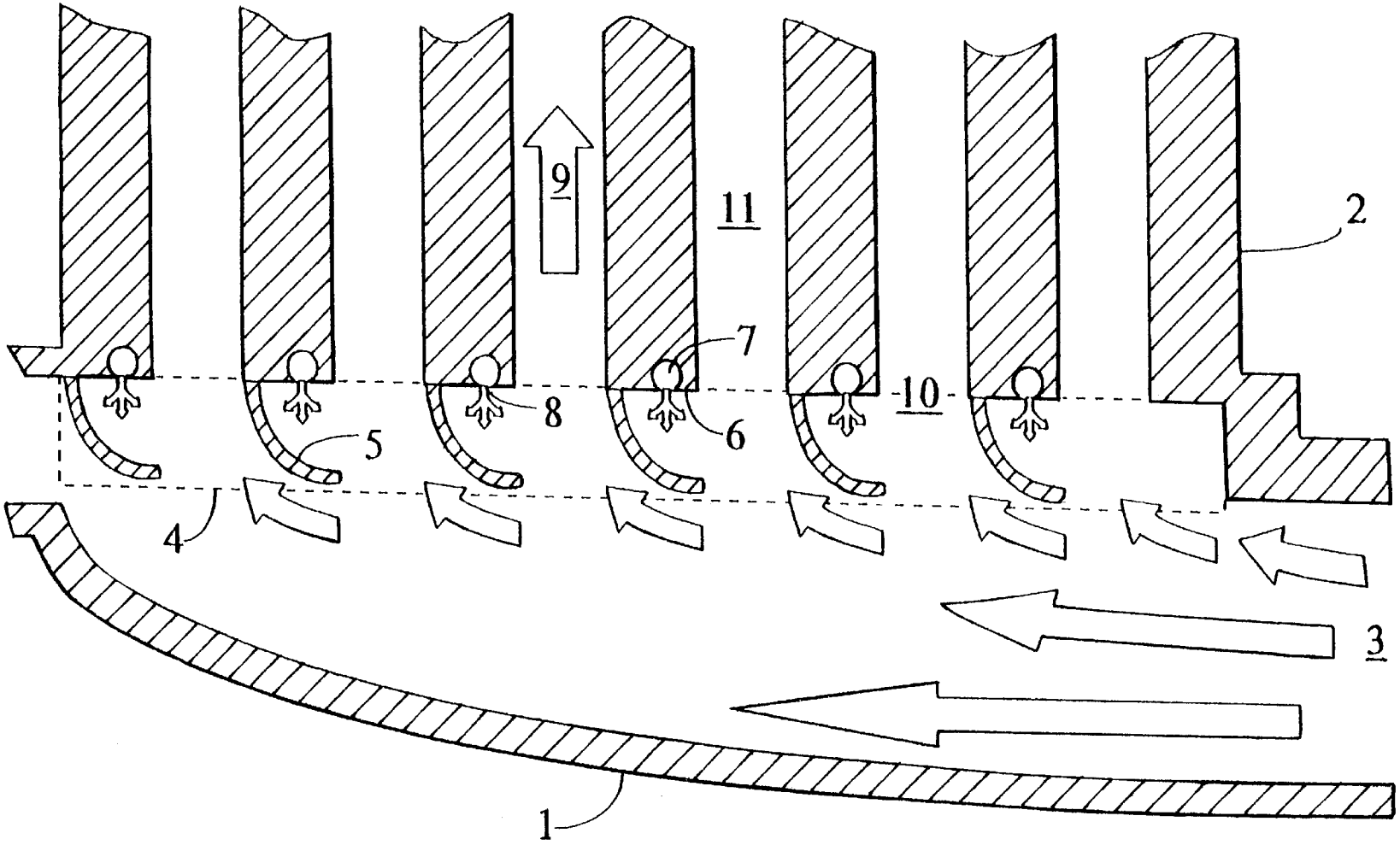
FIGS. 1 and 2 each show a horizontal cross section through a headbox in the region of the transverse distributor which supplies the suspension and/or the microturbulence insert inside the headbox, showing curved flow guide elements at the entry of the microturbulence insert and the additional liquid supply into the channel forming elements of the turbulence insert.
Figure 2:
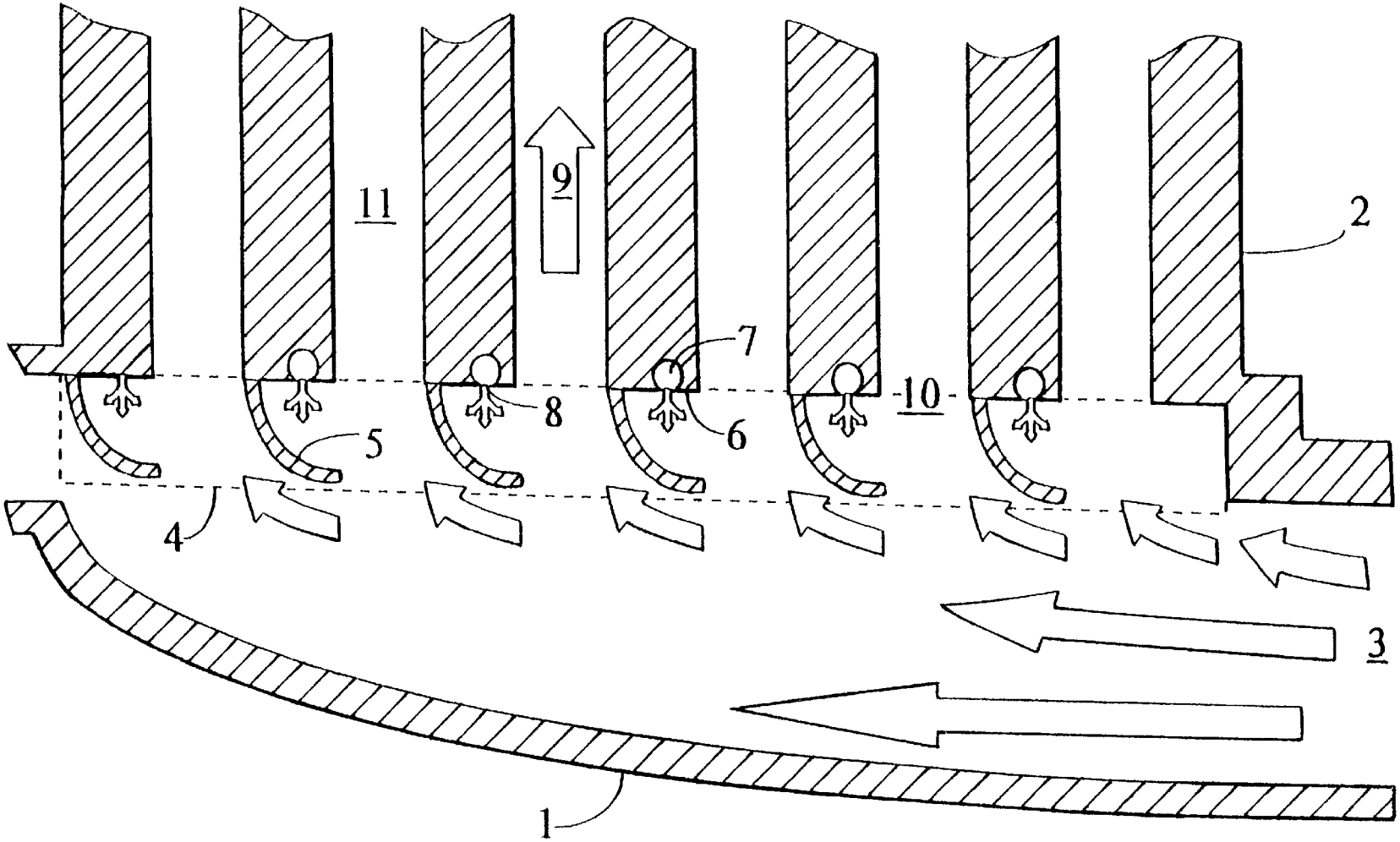

FIGS. 1 and 2 schematically illustrate a cross section through a headbox in the transition region from the transverse distributor 1 which delivers pulp or stock suspension, possibly along with other materials, like wire water, water and/or additives, to the entrance or inlet to the headbox. From there it is transmitted to the microturbulence insert 2 inside the headbox. The stock suspension flow entering through the main supply 3 is illustrated schematically by open arrows.

An antechamber 4 in the headbox is outlined with a dashed line. It does not necessarily represent a delimitable space. It leads to the microturbulence insert 2. There are a large number of curved flow guide elements 5 in the antechamber 4, usually one for each flow channel forming element 6 of the insert 2, across the width of the headbox. Each element 5 has one end fastened to a respective channel forming element 6 of the turbulence insert.

All of the channel forming elements 6 of the insert 2 extend a short distance along the flow path through the headbox. Neighboring elements 6 extend between the top and bottom of the headbox to define narrow width flow channels 11 for the suspension. The drawings suggest a design wherein the elements 6 define narrow width channels which each extend over the full height of the headbox. But, as noted above, the region between neighboring elements 6 may also be divided at levels over the height of the headbox to thereby define a matrix of tubes leading through the insert, e.g. DE 43 20 243 C2, FIG. 13 and U.S. Pat. No. 5,196,091 incorporated herein by reference.

Figure 7:
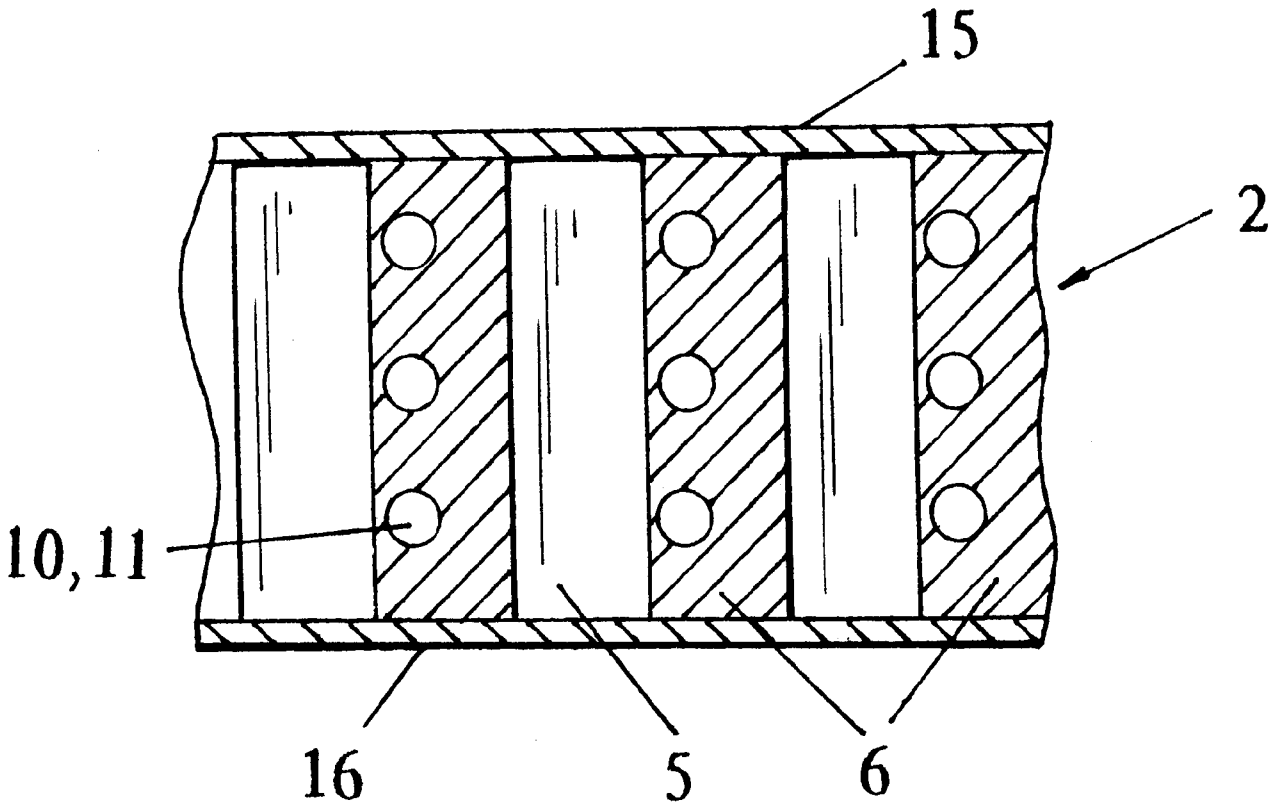
FIG. 7 shows a fragment of a vertical transverse cross section through a headbox at the microturbulence insert.

FIG. 7 illustrates such an insert 2 disposed between the top plate 15 and the bottom plate 16 of the headbox. The channels 11 are not each one slot extending vertically over the entire height of the insert 2. Instead, at each section across the width, there is a respective stack of tubes 11, defining a confined pathway for the respective section across the width.

Each channel forming element 6 of the microturbulence insert 2 or the stack of tubes in FIG. 7 for each section includes a supply line 7 within its upstream end region. The supply line has an exit opening 8 located at the upstream end of the respective element 6. A sectional additional liquid supply exits through an opening 8 from the supply line 7 and produces a localized flow of additional liquid(s) to be mixed into the main flow of suspension and which is preferably also directed counter to the flow direction 9 through the microturbulence insert.

If the flow guide elements 5 were not present at the channel forming elements 6 to thereby also define passageways, the sectionally supplied liquid, supplied respectively through each supply line 7, would be distributed at the entry of the turbulence insert. This would lead to a broadened effective distribution range, perhaps spanning several channel forming elements 6 in width, which is normally undesirable. The flow guide elements 5 instead restrict the effective width of a local additional liquid supply from a supply line 7 to the directly adjacent entry 10 into one channel 11 of the microturbulence insert 2. This causes a desired locally sharper delimitation of the influence of the sectional supply of additional liquid, and enables more precisely placed reaction to faults to be corrected in the transverse profile of the fiber layer produced from the suspension exiting the headbox, particularly the basis weight cross profile and/or the fiber orientation cross profile of the web being produced.

The variants of FIGS. 1 and 2 differ in the respective placements of the supply lines 7 and the flow guide elements 5 on the inlet ends of the channel forming elements 6. In the embodiment of FIG. 2, the exit opening 8 from the supply line 7 lies close after the next adjacent flow guide element 5 in the flow direction across the distributor and the supply line is therefore not "covered over" by the subsequent flow guide element 5 along the distributor 1, whereas the flow guide element 5 hangs over the next entry opening 10 into the microturbulence insert 2. In the embodiment of FIG. 1, at the inlet end of the channel forming elements 6 of the microturbulence insert 2, as viewed in the main flow direction of the stock suspension, the openings 8 from the supply lines 7 are covered over by the trailing flow guide elements 5 for each entry opening 10, which project along a curve into the antechamber 4, and the elements 5 curve counter to the main flow direction. This has the effect of shielding the supply line openings 8, even in the case of a relatively intense supply of liquid through the supply lines 7. Placing the flow guide elements 5 on the elements 6 to overhang the entry openings 10 is not illustrated. However, to improve the shielding effect further, an appropriate overhang may be beneficial.

In an embodiment that is not illustrated, the outflow direction from the supply lines 7 is directed laterally and radially counter to the curvature of the flow guide elements 5, in order to be able to operate with still higher outflow speeds, to effect better mixing and, nevertheless, to limit the effective width across the headbox of the change in consistency and/or quantity.

Figure 3:
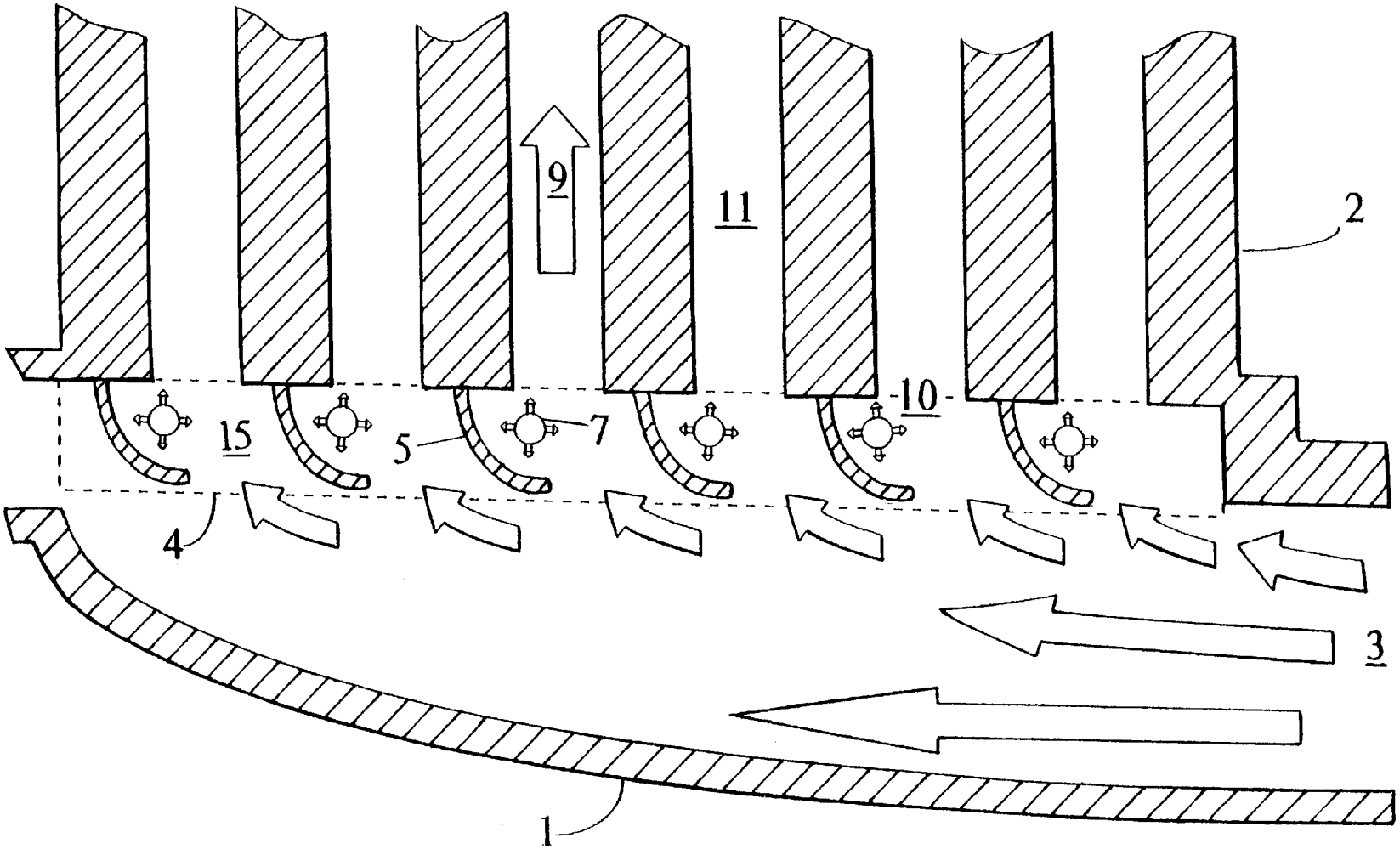
FIG. 3 shows a cross section through a headbox in the region of the transverse distributor and/or the microturbulence insert, having curved flow guide elements at the entry of the microturbulence insert and having additional liquid supply through the top and/or bottom plate of the headbox.

FIG. 3 likewise shows a cross section through a headbox in the transition region from the transverse distributor 1 to the turbulence insert 2. The antechamber 4, which is outlined with a dashed line, leads to the microturbulence insert 2. There are a large number of drilled holes in the top and/or bottom plate 14 of the antechamber 4 and of the headbox, through which liquid can be individually injected into each section of the antechamber 4. Flow guide elements 5 are fitted to the inlet ends of the channel forming elements 6 of the insert 2. These flow guide elements 5 ensure that, irrespective of the quantity of liquid supplied into the antechamber 4 through each supply line 7, the liquid from each line 7 passes exclusively into the nearest channel 11 of the microturbulence insert, and thus affords close delimitation of the sectional flow across the width which flow is to be influenced. The supply line 7 in this embodiment then can either end directly at the bottom plate or at the top plate 15, or else can reach deeper into the antechamber 4, or even can have several exit openings over the length of the line 7 inside the chamber 4, in order to obtain a uniform profile over the z or height direction of the antechamber. However, it is also possible for a height adjustable dip pipe to be selected, with which the profile in each section across the headbox can be influenced individually in the z direction.

The additional supply lines are individually adjustable liquid feeds, which are individually controllably supplied with any of additional suspension, wire water, additives for paper, etc. at selected volumes and flow rates and at a total flow rate selected for achieving the desired flow pattern across the width of the headbox for achieving the desired transverse profiles of basis weight and fiber orientations of the web being produced. Various techniques for controlling proportions are disclosed U.S. application Ser. No. 08/662,980 and in U.S. Pat. No. 5,196,091, both incorporated herein by reference, and involve feeding supplies of different materials together in the feed lines 7 and controlling their relative flow rates with valves, throttles, etc.

The shape of the flow guide elements 5 illustrated in FIGS. 1, 2 and 3 is not required so long as the desired result is achieved. For example, for reasons of simpler production, the flow guide elements 5 may have the shape of a circular segment, parabola or hyperbola, a polygonal shape or else a rectilinear course.

Figure 4:
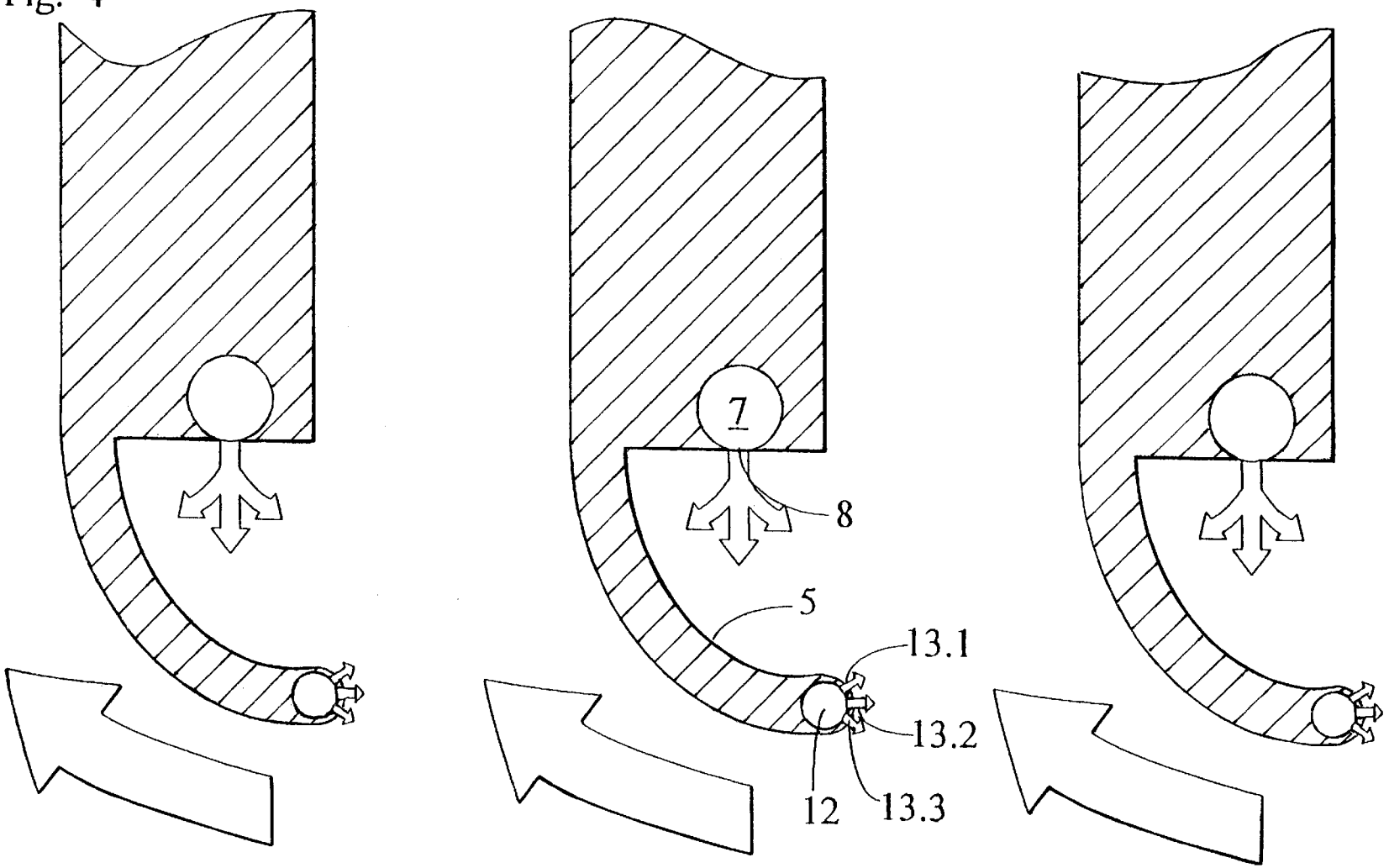
FIG. 4 shows a detail from FIG. 1, with additional flushing of the flow guide vanes at the ends.

One possible design for cleaning or maintaining the cleanliness of the leading, inlet, upstream ends of the flow guide elements 5 is illustrated in FIG. 4. The leading end of each flow guide element 5 is provided with a drilled hole 12 that extends over the height of the element. Each hole 12 in turn leads to one or more slots or holes 13.1, 13.2 and 13.3 with outlets directed upstream of the flow through the antechamber. Either during operation or during an operational shutdown, clarified water or another cleaning liquid can be forced through these drilled holes, so that any fibers or contaminants that had adhered to the leading edges are removed.

Figure 5:
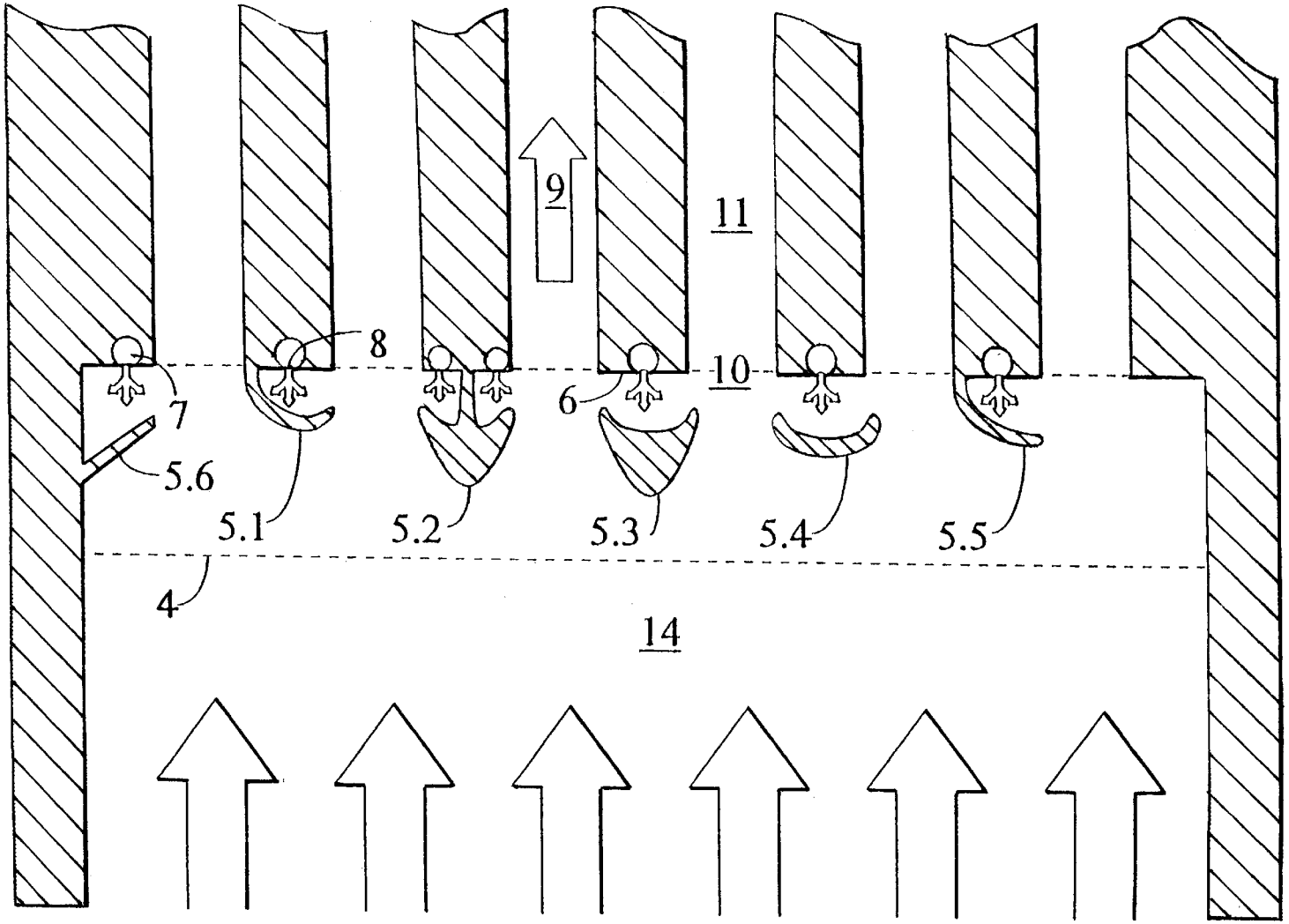
FIG. 5 shows a cross section through a headbox in the region of the intermediate channel leading to the microturbulence insert, with variously curved flow guide element embodiments at the entry to the turbulence insert and the liquid supply into the channel forming elements of the microturbulence insert.
Figure 6:
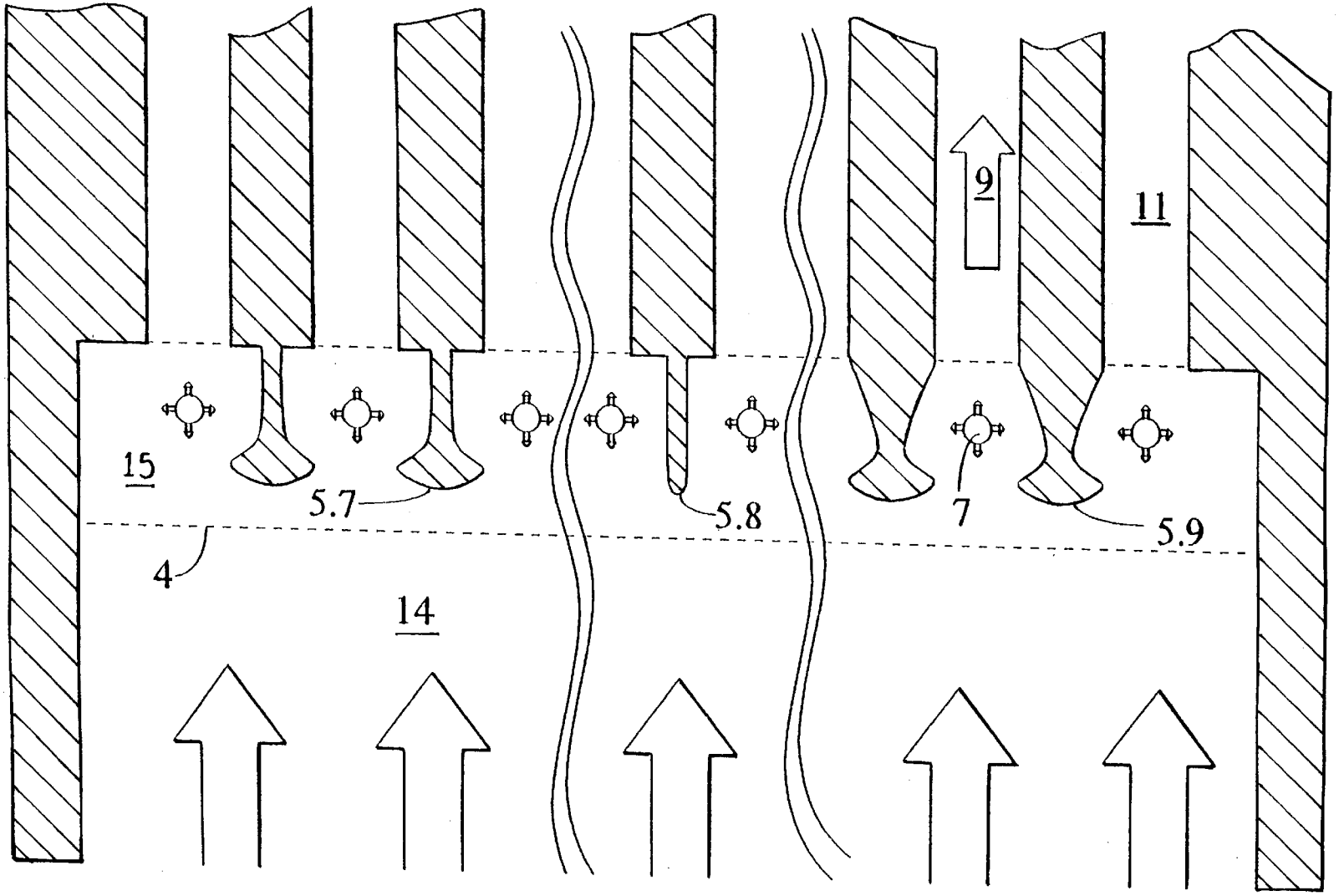
FIG. 6 shows a cross section through a headbox in the region of the intermediate channel to the microturbulence insert, with variously curved flow guide elements at the entry to the microturbulence insert and with additional liquid supply through the top and/or bottom plates of the headbox.

FIGS. 5 and 6 show entry of the stock suspension flow into a microturbulence insert 2 from a space 14, which is located so that the entry flow to the antechamber 4 and into the insert 2 is directed substantially parallel in direction toward the turbulence insert 2, in contrast to the transverse distributors 1 shown in FIGS. 1–3. For instance, the space 14 may be an intermediate channel inside the headbox between two spaced apart turbulence generators 2 or else the space may be in a transverse distributor which is configured such that the parallel flow is established before the liquid enters the turbulence generator shown.

FIG. 5 shows a sectionalized liquid supply, similar to FIGS. 1 and 2. For each narrow channel 11 through the insert 2, one or two supply lines 7 are provided in the inlet ends regions of the elements 6. The outlet openings from the lines 7 are directed counter to the main flow through the chamber 4.

Various embodiments of flow guide elements 5.1–5.6 according to the invention are illustrated in FIG. 5, although all of the flow guide elements in a headbox normally have the same shape. Under appropriate flow conditions, in particular at the lateral edge regions, it may be necessary to employ flow guide elements having different shapes in one headbox. The common factor for all of the illustrated flow guide elements 5 is that they are arranged in front of or to the side of the exit openings 8 from the lines 7 such that direct jets from the additional liquid supply lines 7 are deflected in the direction of the main flow through the respective channels 11 and/or the transfer of a supply of liquid from a further laterally removed supply line 7 is suppressed.

FIG. 6 illustrates a further embodiment having injection of additional liquid into the antechamber 4 via the top and/or bottom plate 15, but is otherwise similar to the design in FIG. 3. In this schematic illustration, the supply lines 7 are all located approximately centrally of and upstream of the entry openings 10 into the microturbulence insert channels 11. Different shapes of flow guide elements are fitted to the webs 6. For example, they either are comprised of a guide plate 5.8 that runs rectilinearly or they have shapes which have a broadening at their ends before joining the element 6 in a narrower width form 5.7, or respectively have an inward bulge approximately at the level of the supply line 7 and then adjoin the elements 6 in a manner beneficial to flow and without edge formation as at 5.9. With reference to the designs of the liquid supply, reference is made to the description of FIG. 3.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for supplying a fiber suspension distributed in a selected manner over the width of the headbox, the headbox comprising:

an inlet end for entrance of the fiber suspension, and an outlet end for exit of the fiber suspension, the headbox having a width dimension and having a top and a bottom;

a microturbulence generating insert in the headbox between the inlet and the outlet ends and comprised of a plurality of channel forming elements arrayed spaced apart across the width of the headbox for defining a plurality of channels through the insert along the flow direction through the headbox;

a supply device for supplying the fiber suspension to the inlet end of the headbox across the width of the headbox;

a machine width antechamber in the headbox upstream of the microturbulence generating insert and downstream of the supply device through which the fiber suspension moves to the microturbulence generating insert in a flow direction;

a plurality of adjustable liquid feeds of respective supplies of liquid, each adjustable liquid feed having an outlet for directing the respective supplies of liquid into the antechamber substantially opposite to the flow direction of the fiber suspension through the antechamber, the adjustable liquid feeds for providing respective supplies of liquid for each channel; and a plurality of suspension flow guide elements, each located away from and at least partially facing respective adjustable liquid feeds, each suspension flow guide element being shaped and positioned for diverting the flow of the fiber suspension from the supply device and through the antechamber generally toward selected ones of the channels of the microturbulence generating insert.

2. The headbox of claim 1, wherein the suspension flow guide elements are shaped and positioned for also interfering with the flow of the fiber suspension from the supply device directly on the adjustable liquid feeds in the antechamber.

3. The headbox of claim 1, wherein each of the suspension flow guide elements is shaped and positioned for directing the liquid from the adjustable liquid feeds into a respective one of the channels.

4. The headbox of claim 1, wherein at least some of the channel forming elements of the microturbulence generating insert have inlet ends facing toward the antechamber, and the adjustable liquid feeds being adapted to feed liquid toward the supply device with respect to the inlet ends of the channel forming elements.

5. The headbox of claim 4, wherein there is a respective adjustable liquid feed at the inlet ends of at least a plurality of the channel forming elements.

6. The headbox of claim 5, wherein the liquid feeds have exits directed such that the liquid from the adjustable liquid feeds is directed counter to the flow direction through the microturbulence generating insert and is directed into the suspension flowing into the channels of the microturbulence generating insert.

7. The headbox of claim 4, wherein the suspension flow guide elements are located at the inlet ends of respective ones of the channel forming elements of the microturbulence generating insert.

8. The headbox of claim 4, wherein the suspension flow guide elements are oriented to extend over the respective adjacent adjustable liquid feeds for preventing liquid from one adjustable liquid feed passing around the respective guide element to a neighboring one of the channels and for additionally directing the second liquid into the suspension flowing past the adjustable liquid feed and into the respective channel.

9. The headbox of claim 4, wherein the headbox has a bottom and a top respectively below and above the antechamber and the microturbulence generating insert;

the channel forming elements are shaped and placed such that the channels are arrayed in respective local sections across the width of the headbox, and at each of the sections, there are a plurality of the channels arrayed between the bottom and the top of the headbox.

10. The headbox of claim 1, wherein the adjustable liquid feeds have exits directed such that the liquid from the adjustable liquid feeds is directed counter to the flow direction through the microturbulence generating insert and is directed into the suspension flowing into the channels of the microturbulence generating insert.

11. The headbox of claim 1, wherein adjacent channel forming elements of the microturbulence generating insert across the width of the headbox define respective channels in the insert between the channel forming elements, and a respective one of the suspension flow guide elements is disposed at the inlet ends of the adjacent channel forming elements of the insert for defining a respective pathway into each channel between the respective adjacent suspension flow guide elements; a respective adjustable liquid feed located generally at each channel between two of the suspension flow guide elements.

12. The headbox of claim 1, wherein the adjustable liquid feeds extend through the channel forming elements and are toward the inlet ends of the channel forming elements.

13. The headbox of claim 1, wherein the adjustable liquid feeds are through at least one of the top and bottom of the headbox at the antechamber.

14. The headbox of claim 1, wherein each of the suspension flow guide elements has a shape selected from the group consisting of curved vane, circular segment, parabola, hyperbola, mushroom shape including a generally large head portion at the end thereof away from the insert, polygonal and rectilinear.

15. A headbox for supplying a fiber suspension distributed in a selected manner over the width of the headbox, the headbox comprising:

an inlet end for entrance of the fiber suspension, and an outlet end for exit of the fiber suspension, the headbox having a width dimension and having a top and a bottom;

a microturbulence generating insert in the headbox between the inlet and the outlet ends and comprised of a plurality of channel forming elements arrayed spaced apart across the width of the headbox for defining a plurality of channels through the insert along the flow direction through the headbox, at least some of the channel forming elements having inlet ends facing toward the antechamber;

a supply device for supplying the fiber suspension to the inlet end of the headbox across the width of the headbox;

a machine width antechamber in the headbox upstream of the microturbulence generating insert and downstream of the supply device through which the fiber suspension moves to the microturbulence generating insert in a flow direction;

a plurality of adjustable liquid feeds of respective supplies of liquid, each adjustable liquid feed having an outlet directing the respective supplies of liquid into the antechamber and providing respective supplies of liquid for each channel; and a plurality of suspension flow guide elements located in the antechamber generally in the region of at least one of the adjustable liquid feeds, each of the suspension flow guide elements being generally curved in shape having one end attached at the inlet end of the channel in the channel forming element, and the one end being parallel to the channel, and having another end curving toward the flow direction of the fiber suspension through the supply device toward the antechamber, each suspension flow guide element being shaped and positioned for diverting the flow of the fiber suspension from the supply device and through the antechamber generally toward selected ones of the channels of the microturbulence generating insert.

* * * * *